United States Patent [19]

Jesme

[11] 4,332,212

[45] Jun. 1, 1982

[54] APPLICATOR FOR NORMALLY VISCOUS SUBSTANCES

[75] Inventor: Philip O. Jesme, South St. Paul, Minn.

[73] Assignee: The Smead Manufacturing Company, Hastings, Minn.

[21] Appl. No.: 191,170

[22] Filed: Sep. 26, 1980

[51] Int. Cl.[3] ..... B05C 1/02; B67D 5/00

[52] U.S. Cl. ..... 118/202; 118/211; 118/259; 118/411; 222/146 H; 222/169

[58] Field of Search ..... 118/259, 410, 202, 411, 118/406, 212, 211; 101/119

[56] References Cited

U.S. PATENT DOCUMENTS

| | | | |
|---|---|---|---|
| 346,870 | 8/1886 | Sherck et al. . | |
| 2,553,592 | 5/1951 | Kucklensky | 118/259 X |
| 3,152,011 | 10/1964 | Gerard | 118/259 X |
| 3,255,729 | 6/1966 | Weis . | |
| 3,294,018 | 12/1966 | Heonis | 101/119 X |
| 3,339,485 | 9/1967 | Rytterholm . | |
| 3,408,984 | 11/1968 | Pullins . | |
| 3,568,636 | 3/1971 | Lockwood . | |
| 3,788,271 | 1/1974 | Carpenter et al. . | |

*Primary Examiner*—John P. McIntosh

*Attorney, Agent, or Firm*—Merchant, Gould, Smith, Edell, Welter & Schmidt

[57] ABSTRACT

An improved apparatus for applying substances, some of which can be highly viscous in nature, to desired surfaces is disclosed. The applicator (10) can include a housing (12) defining a closed plenum (40) which is filled with a fluid medium. The housing (12) is mounted for rotation about an axis, and an applicator shoe (28) is mounted at a first end (14) of the housing (12). A duct or tubular member (22) is disposed radially inwardly from the shoe (28) with respect to the axis of rotation. Centrifugal delivery conduits (32) are provided to afford fluid communication between an interior passageway (26) of the tubular member (22) and a chamber (38) formed in the shoe (28). As the housing (12) rotates about the axis, substance introduced into the interior passageway (26) of the duct (22) is centrifugally impelled to the shoe (28) through the conduit means (32).

7 Claims, 4 Drawing Figures

10
12
14
16
18
20
22
24
26
28
30
38
48
50
52
54
56
58
60
62
64
66
3
4

12
14
16
18
20
22
24
26
30
38
40
42
44
48
50
52
54
56
60
66

APPLICATOR FOR NORMALLY VISCOUS SUBSTANCES

TECHNICAL FIELD

The invention of the present application refers broadly to the field of applying highly viscous substances to surfaces. More specifically, however, it relates to apparatus for applying adhesives to file portions in order to apply bindings thereto. Narrowly, it is concerned with an application apparatus for applying a viscous hot melt adhesive to join a binding to file portions.

BACKGROUND OF PRIOR ART

Devices for applying viscous substances to paper, cardboard, and other surfaces are known in the art. An early illustration of one structure used to accomplish this function in U.S. Pat. No. 346,870 issued to I. Sherck et al on Aug. 3, 1886. The device of that patent was used for effecting the coating of paper and other material with a wax lamina. Its structure included a cylinder which was mounted on a hollow shaft. The cylinder was made to rotate with the shaft so that melted paraffin or other wax fed into the shaft would be centrifugally displaced through perforations in the shaft and would pass outwardly to the surface of the cylinder drum. The cylinder drum was also perforated so that the paraffin could ooze through these perforations and be applied by the drum to the paper desired to be coated.

A more recent illustration of a similar device is U.S. Pat. No. 3,408,984 (Pullins) issued on Nov. 5, 1968. The structure of that reference also utilized a drum mounted for rotation with a hollow shaft. Adhesive introduced into the shaft was allowed to exit through openings in the shaft into the inside of the drum. The drum included a multiplicity of perforations formed in the surface thereof. A porous or liquid permeable applicator was positioned on the drum at a location so that the applicator could receive adhesive oozing through perforations in the drum and apply that adhesive to a desired surface. Perforations which were not covered by the porous or liquid permeable applicator were plugged so that adhesive would not flow through those pores.

In the case of both of these structures, the radially outward flow of the substance to be deposited was occasioned by the centrifugal force imparted thereto as the result of rotation of the shaft and cylinder. One specific problem, however, with both structures is that there is no means for insuring equal distribution of the substance around the peripheral interior of the drum. With the Sherck reference, there is not even any means for insuring the location about the periphery of the drum at which the substance would be dispensed. Additionally, in view of the highly viscous nature of the substances with which the structures of those two references are to be used, those references don't teach any method for keeping the substance relatively fluid during the application process. Those structures are deficient also in that they are designed for application of the dispensed substance to a surface having a fixed dimension. Little flexibility was incorporated to adjust the area of dispensing should application of the substance to a smaller surface be necessary.

It is these deficiencies in the art which the invention of the present application is directed. The structure in accordance with this invention is an improved apparatus for centrifugally dispensing a viscous substance with uniform distribution at the area of dispensing.

BRIEF SUMMARY OF THE INVENTION

The present invention is an improved apparatus for applying a high viscosity substance such as a hot melt adhesive to a desired surface. The apparatus includes an applicator which has a chamber formed therein. The applicator has an external surface by which application of the normally highly viscous substance is applied to paper, cardboard, etc. A multiplicity of perforations formed in the applicator allow communication between the chamber and the application surface so that the substance introduced into the chamber can ooze through the perforations and be dispensed by the application surface. The applicator is mounted so that it can rotate about an axis. The substance to be dispensed is centrifugally fed to the applicator from a reservoir which is spaced radially inward from the applicator. Conduit means are included to provide the radial communication between the reservoir and the chamber.

In certain embodiments, means can be provided to keep the viscous substance in a fluid state until it is applied to the desired surface. This can be accomplished by providing a fluid medium filled plenum which encloses the conduit means and which has at least one heating element disposed therein to heat the fluid medium.

The applicator can include a base plate through which the conduit means passes. A capping member of a desired length can be selected to be mounted on the base plate. A channel formed in a side of the capping member which abuts the base plate defines the chamber formed in the applicator.

The capping member can be manufactured from brass which is nickel plated. Various sized capping members can be used with the structure in order to control the area over which the viscous substance is applied.

The invention of this application is thus an improved viscous substance application apparatus. The specific advantages of the invention will become more apparent with reference to the accompanying drawings, description of the preferred embodiment, and claims.

BRIEF DESCRIPTION OF THE DRAWINGS

FIG. 2 is a perspective view of the capping element of the apparatus illustrated in FIG. 1 in an inverted orientation;

DETAILED DESCRIPTION OF THE INVENTION

Figure 1:
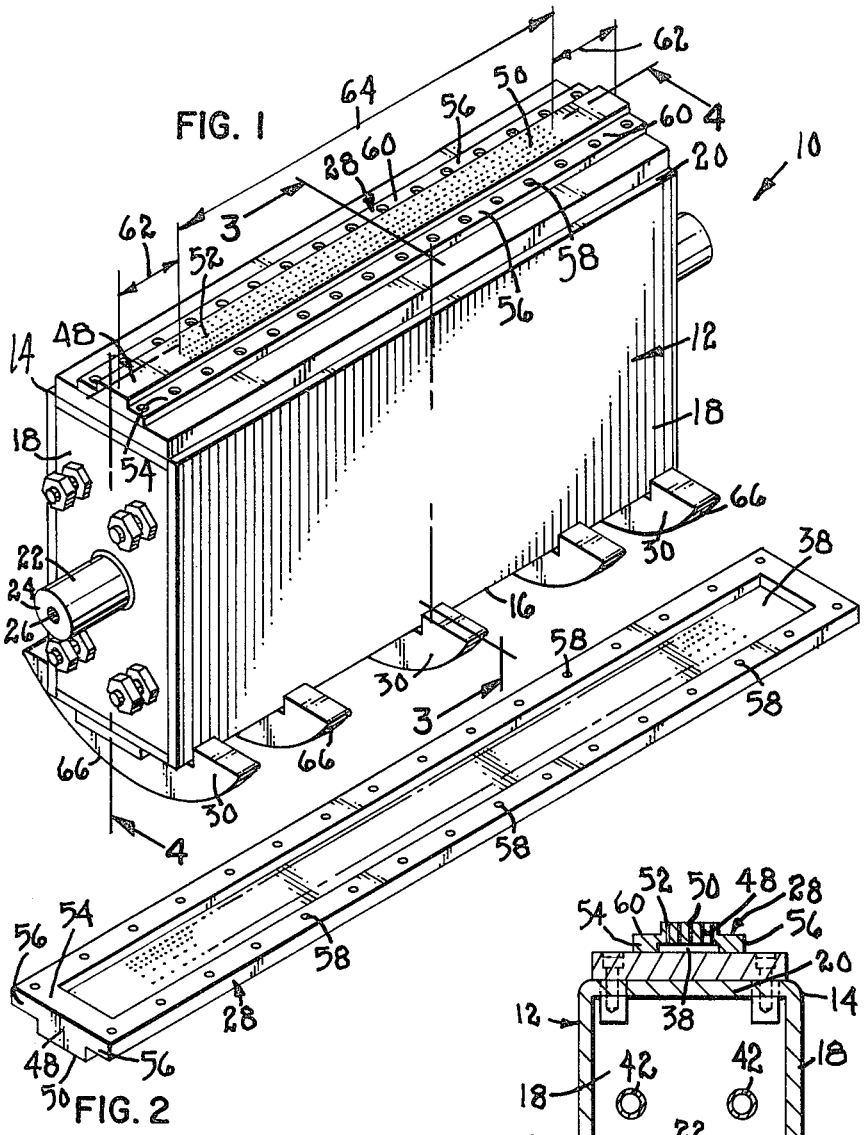
FIG. 1 is a view in perspective of the application apparatus in accordance with the present invention.

Referring now to the drawings wherein like reference numerals denote like elements throughout the several figures, FIG. 1 illustrates an applicator, generally identified by reference numeral 10, in accordance with the present invention. The applicator can include a housing 12 having a first, or applicator, end 14, and a second, or counterweight, end 16. The housing 12 is completely enclosed and includes four side walls 18 and opposite end walls 20. The housing 12 is capable of being mounted for rotation about an axis.

A tubular member 22 is shown passing centrally through the housing 12. This duct 22 serves to convey a supply of a substance, which can be of a nature wherein it is in a normally viscous state, to a station within the housing 12. This tubular duct 22 can additionally function to mount the housing 12 for rotation, the wall 24 of the duct 22 capable of being disposed concentric to the axis of rotation. The duct 22 can be journaled in suitable bearings, and means (not shown) can be provided to continuously supply the substance to be dispensed into an interior passageway 26 extending through the duct 22 even as the duct 22 rotates with the housing 12 about the axis. It will be understood, however, that the duct 22 need not be aligned along the axis of rotation.

An applicator shoe 28 is mounted to the first end 14 of the housing 12, and counterweights 30 are mounted to the second end 16. Counterweights 30 can be provided to balance the weight of the housing 12 about the tubular member 22 so that undue flexing is not imposed on the shaft upon which the housing 12 rotates.

Figure 4:
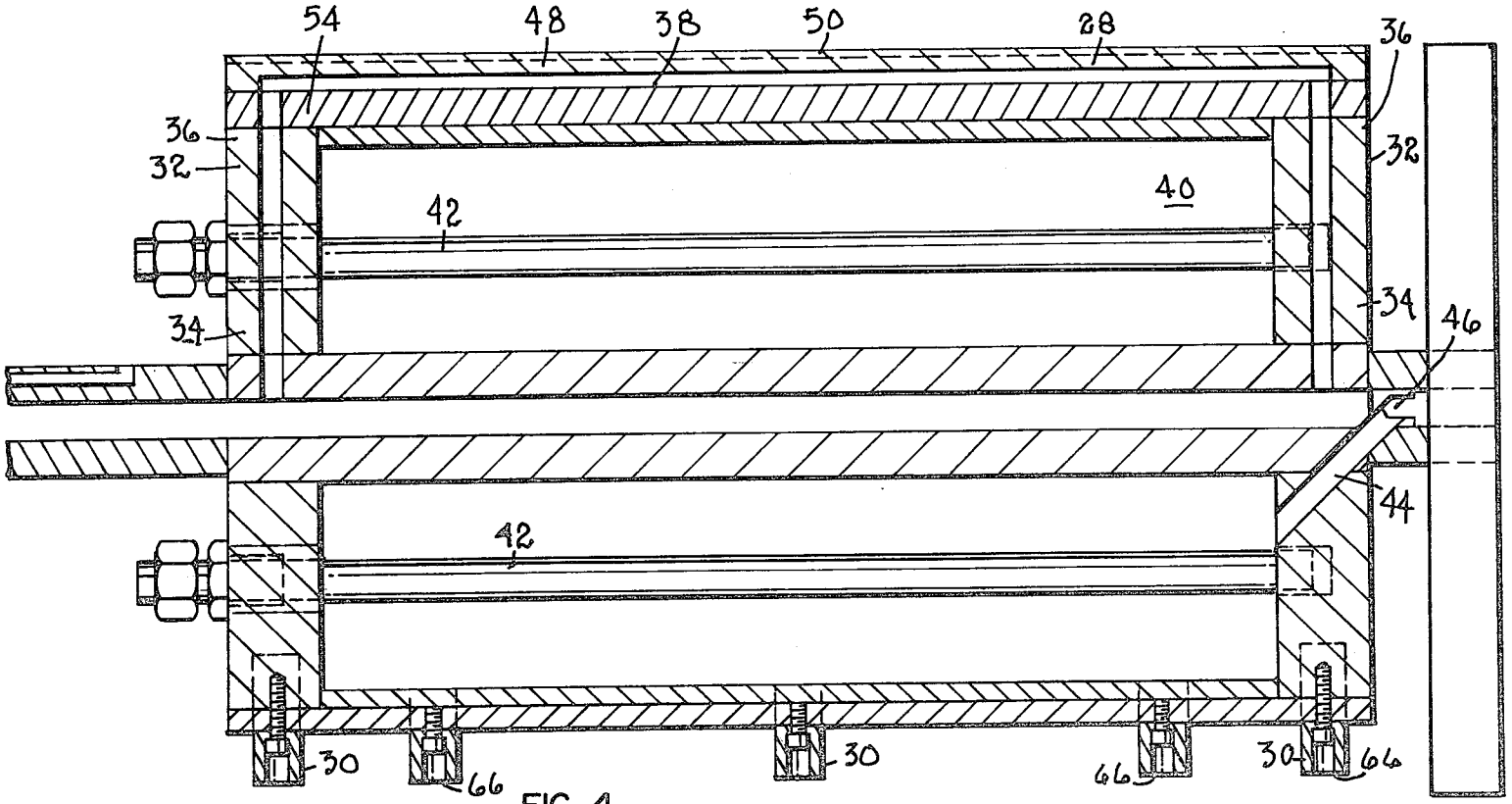
FIG. 4 is a view taken along the line 4—4 of FIG. 1.

Referring now to FIG. 4, conduit means 32 are provided to effect centrifugal delivery of the substance to be applied by the applicator 10 from the duct element 22 to the applicator shoe 28. Two conduits 32 are illustrated in the figure extending generally radially outward from the tubular member 22 to the shoe 28. The conduits 32 communicate at their first ends 24 with the passageway 26 extending through the duct element 22. At their second ends 36, the conduits 32 communicate with a chamber 38 formed in the applicator shoe 28. As the housing 12 is made to rotate about its axis, the substance introduced into the duct element 22 will be centrifugally impelled through the conduits 32 into the applicator chamber 38. The chamber 38 will be supplied by the duct element/reservoir 22 so that a pressure will be maintained within the chamber 38.

Because of the highly viscous nature of some substances which can be dispensed by this applicator 10, they are frequently fed to the applicator shoe 28 from a source in a heated state. Heating means can be provided within the housing 12 to maintain the substance in a flowable state. The outer surface of the housing 12 can define within its walls 18, 20 a plenum 40 enclosing the centrifugal delivery conduits 32. The drawings illustrate a number of heat imparting elements 42 which can heat a fluid medium filling the plenum 40 so that heat transferred to the medium can, in turn, be conducted to the conduits 32.

In one structure built, electrical cartridge-type heaters have been used. Such heaters are commercially available, and one such type heater is marketed under the trade name CHROMATOX.

A number of fluids are acceptable as the medium by which the plenum 40 can be filled. Various types of oils have been found to serve this purpose optimally because of their heat transfer properties.

As can be seen, the oil can completely surround the tubular member 22 and enclose a significant peripheral portion of the centrifugal delivery conduits 32. In order to effect maximum heat transfer to the substance to be applied, it is desirable that the plenum 40 be maintained completely filled throughout operation of the device. Since, however, media used for the heat transfer function will tend to expand when heated, an expansion tank (not shown) can be provided to afford egress of expanded fluid from the plenum 40. A passage 44 is provided from the plenum 40 to a port 46 which communicates with the expansion tank.

Since, as previously stated, it is desirable to maintain the plenum 40 totally filled, the oil which has passed to the expansion tank as it becomes heated should be allowed to return to the housing 12 as the oil cools. To effect this return flow, the expansion tank should be positioned at a height higher than the upper most reaches of the housing 12 as it rotates about its axis. Gravity drain will, therefore, cause fluid in the tank to return to the housing 12 to maintain the plenum 40 totally filled.

Figure 3:
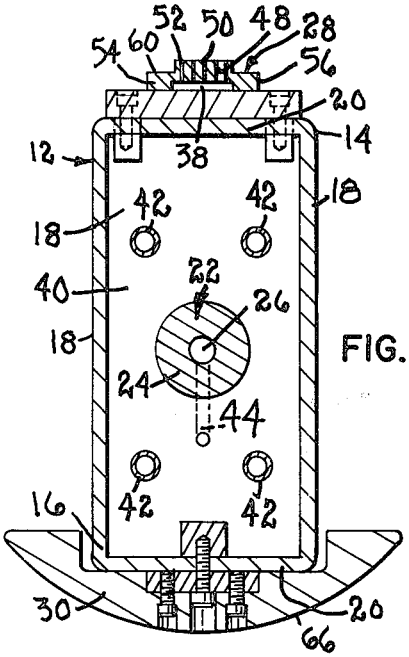
FIG. 3 is a view taken along the line 3—3 of FIG. 1.

With reference now to FIGS. 1, 2, and 3 for a more detailed description of the applicator shoe 28, the shoe 28 includes a capping member 48 which has a surface 50 by which a substance such as a hot melt adhesive is applied. The capping member 48 is porous along a portion of its length, having a multiplicity of perforations 52 formed therein. The perforations 52 extend through the thickness of the capping member 48 so that they provide communication orifices between the chamber 38 formed in the shoe 28 beneath the capping member 48 and the application surface 50. Size of the perforations 52 can be varied from a very small diameter depending upon the substance to be dispensed and the desired rate of flow.

The shoe 28 further includes a base plate 54 by which the capping member 48 is supported. The base plate 54 defines a pair of flanges 56 extending laterally from the capping member 48, by which flanges 56 the shoe 28 can be affixed to the housing 12. Holes 58 are provided in the flanges 56 for receipt of screws or other appropriate means for affixing the shoe 28 to the housing 12.

As shown in the figures, the capping member 48 is disposed with respect to the base plate 54 so that it defines a plane spaced from a plane defined by the base plate 54. When viewed in cross section, this structure is shaped as an inverted T. By spacing the application surface 50 from the upper surface 60 of the mounting flanges 56, interference with the application process by either the flanges 56 or the mounting screws is precluded.

As is best illustrated in FIG. 1, the perforations 52 formed in the capping member 48 can be made to terminate at distances 62 from the ends of the shoe 28 so as to control the length 64 of the application surface 50 along which the substance dispensed is applied. It will be obvious, however, to one of skill in the art that this control can be accomplished in other manners. For example, rather than providing a series of shoes with each of the shoes having a capping member of identical length but with a different length 64 of surface 50 over which the perforations 52 extend, a series of shoes having capping members of different lengths with perforations 52 extending through the full length of each capping member can be used. In any case, however, the shoe 28 must be long enough so that the chamber or channel 38 formed therein will communicate with the second ends 36 of the centrifugal delivery conduits 32.

As previously stated, the rotation of the housing 12 about its axis will cause a channeled centrifugal flow of the substance to be dispensed in a direction radially outward, with respect to the axis of rotation, from a centrally disposed reservoir 22 to the chamber 38 formed in the shoe 28. Random centrifugal flow of the substance is precluded. The substance is channeled directly to a locus, restricted angularly with respect to the axis of rotation, at which it is applied. Pressure will, thereby, be built up in the chamber 38 formed in the shoe 28. Because of this pressure, the substance will be caused to ooze out onto the application surface 50 of the shoe 28 through the pores 52 formed in the capping member 48. Typically, these pores 52 would be very fine in nature so that the substance would not ooze therethrough without the assistance of the centrifugal force.

It has been found that, when the shoe 28 is manufactured from certain materials, the pores 52 easily become clogged. It has been found that, when the substance being dispensed is a hot melt adhesive, clogging of the perforations 52 can be minimized by manufacturing the shoe 28 out of a nickel-plated brass.

One application for the device is applying a hot melt adhesive to rigid cardboard portions which are joined together by a binding to form a folder. Typical binders are of different lengths, such as letter size and legal size, and the particular shoe 28 and length of capping member 48 through which perforations 52 extend can be selected in view of the particular type of folders being manufactured.

When the device is being used for this application, counterweights 30 mounted to the housing 12 at its second end can function as a feeding means to position the folder at a proper location so that the adhesive can be applied correctly. As the housing 12 is made to rotate, arcuate surfaces 66 on the counterweights 30 can be made to frictionally engage the folder portions to urge them into position so that the applicator shoe 28, as the housing 12 continues to rotate, is able to engage the folder at the proper location.

Numerous characteristics and advantages of my invention have been set forth in the foregoing detailed description of the invention. It will be understood, however, that this disclosure is, in many respects, only illustrative. Changes may be made in detail, particularly in matters of shape, size, and arrangement of parts, without exceeding the scope of the invention. The scope of protection is, properly, defined in the language of the appended claims.

What is claimed is:

1. Apparatus for applying a normally highly viscous substance to article surfaces, comprising:

(a) an applicator having a chamber formed therein, an application surface, and a multiplicity of perforations providing communication between said chamber and said surface, said applicator disposed for revolution about an axis;

(b) a substance reservoir spaced radially inward from said applicator and disposed for movement with said applicator about said axis;

(c) conduit means providing radial communication between said reservoir and said chamber;

(d) at least one heat imparting element positioned proximate said conduit means; and (e) a fluid filled plenum enclosing both said conduit means and said at least one heat imparting element.

2. Apparatus in accordance with claim 1 wherein said applicator is oriented for revolution about said axis with said surface facing radially outward with respect to said axis.

3. Apparatus in accordance with claim 1 wherein said reservoir comprises a tubular member having a longitudinal axis coinciding with said axis about which applicator revolves, and wherein said apparatus further comprises means for supplying said tubular member.

4. Apparatus in accordance with claim 1 wherein said fluid medium is oil.

5. Apparatus in accordance with claim 1 further including a tank communicating with said plenum, said tank disposed at a height higher than the height at which said plenum is disposed.

6. Hot melt adhesive application apparatus, comprising:

(a) an enclosed housing having first and second ends and an axis intermediate said ends about which said housing rotates, said housing containing a liquid medium;

(b) applicator means mounted to said housing proximate said first end, said applicator means extending generally parallel to said axis;

(c) an adhesive reservoir disposed radially inwardly from said applicator means toward said axis;

(d) centrifugal delivery means for conveying adhesive from said reservoir to said applicator means as said housing rotates about said axis, said delivery means passing through said medium;

(e) means for heating said medium; and (f) counterweights mounted to said housing proximate said second end.

7. Apparatus in accordance with claim 6 wherein said first and second ends are angularly spaced 180 degrees with respect to one another about said axis and said counterweights comprise feeding means to move articles to which adhesive is to be applied to a position at which said applicator means can apply adhesive to the articles as it revolves about said axis.

* * * * *